US009598941B1

(12) United States Patent
Upchurch et al.

(10) Patent No.: US 9,598,941 B1
(45) Date of Patent: Mar. 21, 2017

(54) DETONATING CORD CLIP

(71) Applicant: OWEN OIL TOOLS LP, Houston, TX (US)

(72) Inventors: David E. Upchurch, Godley, TX (US); Paul E. Noe, Benbrook, TX (US); Benjamin O. Potter, Crowley, TX (US); Matthew C. Clay, Burleson, TX (US); Dan W. Pratt, Benbrook, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 0 days.

(21) Appl. No.: 15/349,598

(22) Filed: Nov. 11, 2016

Related U.S. Application Data

(63) Continuation of application No. 14/869,388, filed on Sep. 29, 2015, now Pat. No. 9,523,265.

(60) Provisional application No. 62/058,487, filed on Oct. 1, 2014.

(51) Int. Cl.

| | |
|---|---|
| ***F42D 1/04*** | (2006.01) |
| ***E21B 43/117*** | (2006.01) |
| ***C06C 5/06*** | (2006.01) |

(52) U.S. Cl.
CPC ..... *E21B 43/117* (2013.01); *C06C 5/06* (2013.01); *F42D 1/041* (2013.01)

(58) Field of Classification Search
CPC ..... F42D 1/02; F42D 1/00; F42D 1/04; F42D 1/043; F42D 1/16
USPC ..... 89/1.15, 1.151; 102/306–310, 320–322, 102/275.8, 275.7, 275.4, 275.1, 275.2; 175/4.6
See application file for complete search history.

(56) References Cited

U.S. PATENT DOCUMENTS

| | | | | |
|---|---|---|---|---|
| 6,439,121 | B1 * | 8/2002 | Gillingham | C06C 5/06 102/275.12 |
| 9,523,265 | B2 * | 12/2016 | Upchurch | E21B 43/117 |
| 2010/0263523 | A1 * | 10/2010 | LaGrange | G08B 13/2437 89/1.15 |

* cited by examiner

*Primary Examiner* — Reginald Tillman, Jr.
(74) *Attorney, Agent, or Firm* — Mossman, Kumar & Tyler PC

(57) ABSTRACT

A perforating gun that has a detonator section in which a window is formed is assembled by: disposing a detonating cord in an inner bore of the perforating gun; fixing a clip to a detonator; gripping the clip with an installation tool; inserting the clip laterally through the window of the detonator section using the installation tool; and attaching the clip to the detonator cord by pressing the clip against the detonator cord using the installation tool. The clip has a planar base, an opening formed in the base for receiving the detonator, and a pair of prongs extending from the base, wherein each prong of the pair of prongs extends from an edge of the base and has a gripping end.

11 Claims, 4 Drawing Sheets

DETONATING CORD CLIP

CROSS REFERENCE TO RELATED APPLICATIONS

This application is a continuation of U.S. application Ser. No. 14/869,388, filed on Sep. 29, 2015, which takes priority from U.S. Provisional Application Ser. No. 62/058,487, filed Oct. 1, 2014, the disclosures of which are incorporated herein by reference in its entirety.

TECHNICAL FIELD

The present disclosure relates to devices and methods for energetically coupling a detonating cord to one or more detonating cords.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent to the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

Conventional perforating guns include detonating cords for transmitting a detonation between two locations. Detonating cords can be detonated using detonators. Illustrative detonators are disclosed in U.S. Pat. Nos. 4,762,067, 4,716,832, 4,542,695, 3,991,679, the contents of which are incorporated by reference for all purposes. The present disclosure addresses the need to easily form a reliable ballistic connection between a detonator and a detonating cord.

SUMMARY

In aspects, the present disclosure provides an apparatus for perforating a wellbore. The apparatus may include an enclosure receiving at least one shaped charge; a detonating cord connected to the at least one shaped charge; a detonator section associated with the enclosure, the detonator section a longitudinal bore and a window, wherein the detonating cord extends longitudinally through the bore of the detonator section; a detonator disposed in the detonator section and projecting into the bore of the enclosure, the detonator being configured to generate a high order detonation; and a clip connecting the detonator to the detonating cord, the clip having a planar base, an opening formed in the base for receiving the detonator, and a pair of prongs extending from the base, wherein each prong of the pair of prongs extends from an edge of the base and has a gripping end compressively securing the detonating cord against a face of the detonator.

In aspects, the present disclosure provides an apparatus for use with a perforating tool for perforating a wellbore. The perforating tool may include a section having a window and a detonating cord disposed in a bore of the section. The apparatus may include a detonator configured to generate a high order detonation; a clip connecting the detonator to the detonating cord, the clip having a base and prongs extending from opposing sides of the base, the base having an opening for receiving the detonator, and the prongs having gripping ends compressively securing the detonating cord against a face of the detonator; and an installation tool having: a handle, a pair of pincers extending from the handle, the pincers having ends complementary to the base of the clip, the pincers further having an expanded position wherein the base can be received between the pincer ends, and a plunger operatively connected to the pincer ends and expanding the pincers to an expanded position.

In still further aspects, the present disclosure provides a method for assembling a perforating gun that has a detonator section in which a window is formed. The method includes: disposing a detonating cord in an inner bore of the perforating gun; fixing a clip to a detonator; gripping the clip with an installation tool; inserting the clip laterally through the window of the detonator section using the installation tool; and attaching the clip to the detonator cord by pressing the clip against the detonator cord using the installation tool. The clip has a planar base, an opening formed in the base for receiving the detonator, and a pair of prongs extending from the base, wherein each prong of the pair of prongs extends from an edge of the base and has a gripping end.

It should be understood that examples of certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
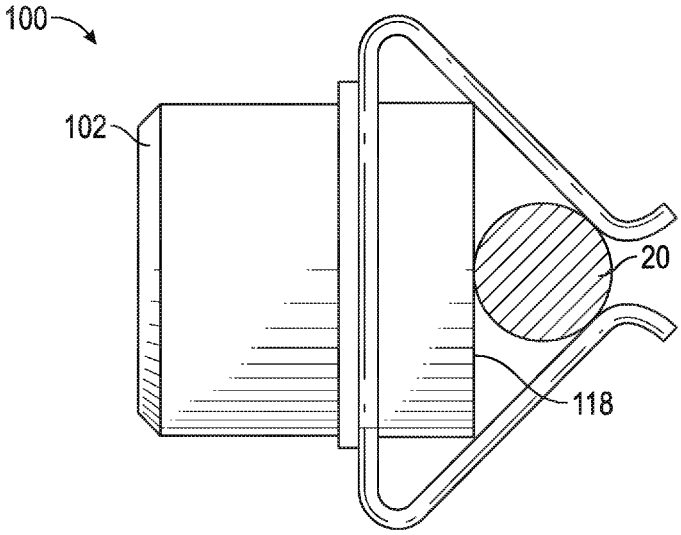
FIG. 1 illustrates a side view of a detonator with a clip according to one embodiment of the present disclosure.

The present disclosure relates to devices and methods for facilitating the assembly and enhancing the reliability of wellbore perforating tools. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring now to FIG. 1, there is shown one embodiment of a retention member 100 that energetically couples a detonating cord 20 to a detonator 102. Merely for convenience, the retention member 100 will be hereafter referred to as a "clip." However, it should be understood that no particular shape, dimension or other characteristic is implied by the term "clip." The clip 100 presses a detonating cord 20 against the detonator 102 to energetically couple the detonating cord 20 to the detonator 102. It should be noted that, in this embodiment, the contact between the detonator 102 and the detonating cord 20 is only along an outer circumferential surface of the detonating cord 20. It should be further noted that, in this embodiment, the detonator 102 does not surround, cover, or otherwise partially or completely enclose an end (not shown) of the detonating cord 20. The detonator 102 may be any device that generates a high-order detonation in response to an applied signal (e.g., electrical signal). The detonator 102 may be formed of one or more energetic materials (e.g., RDX, HMX, etc.). By energetically coupled, it is meant that there is sufficient contact between the detonator 102 and the detonating cord 100 to allow the energy released by the detonator 102 to detonate the detonating cord 100.

The clip 100 provides ease of attachment to a detonating cord, which may have a circular cross-section. The clip 100 has a spring action in that the clip 100 opens up and then closes to shut around the detonating cord 20. The resulting tight connection reduces the risk that the detonator 102 will separate from the detonating cord 20 under vibration and/or high temperatures. Moreover, removal is only possible by a user that intentionally pulls the clip 100 off the detonating cord 20.

Figure 2:
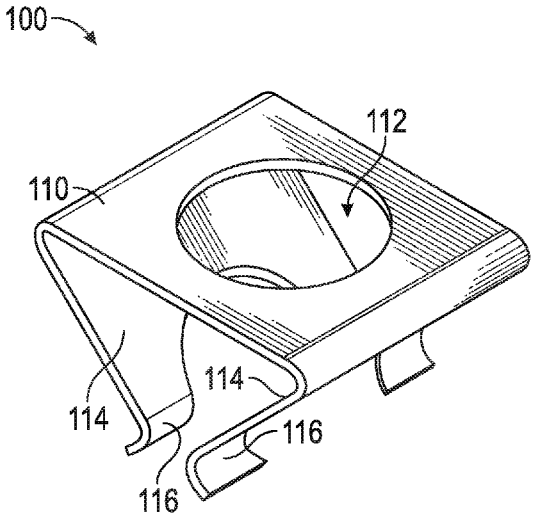
FIG. 2 isometrically illustrates the FIG. 1 embodiment.

Referring now to FIGS. 1 and 2, in one embodiment, the clip 100 is a thin sheet-like "U-shaped" member that includes a base portion 110, a central opening 112, and converging prongs 114. The base portion 110 may be planar and wider than the detonator 102. The opening 112 is formed in the base portion 110 and has a diameter sized to fit substantially around the detonator 102. While the opening 112 is shown as closely conforming to the cross-sectional profile of the detonator 102, such a shape is not necessary. In embodiments, a fastening element 115 may be used to fix the clip 100 to the detonator 102. For example, the fastening element 115 may be a ring, flange, or other annular member that captures the base portion 110 against a ledge or shoulder (not shown) formed on the detonator 102.

The prongs 114 are flexible members that project from an edge of or juncture with the base portion 110 and terminate at gripping ends 116. The prongs 114 may be formed of a resilient material that can generate a spring force when flexed or otherwise deformed. The gripping ends 116 can separate from one another to form a gap that allows the detonating cord 20 to pass through. The gripping ends 116 can also press the detonating cord 20 against a contact face 118 of the detonator 102. As shown, the prongs 114 are not parallel as in a conventional "U-shape." Rather, the prongs 114 more resemble a triangular shape. That is, the junctures of the prong ends and the base portion 110 are separated by a greater distance than the distance separating the gripping ends 116.

Figure 3:
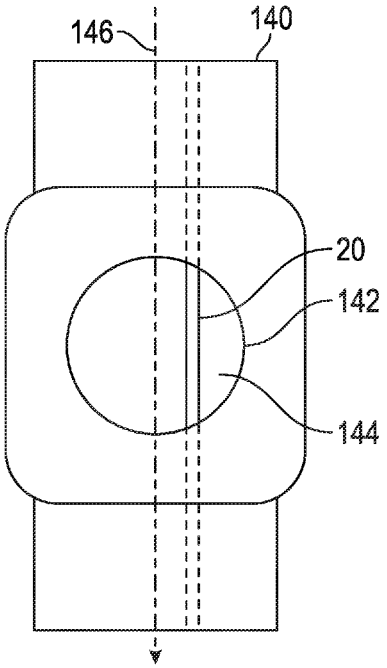
FIG. 3 illustrates a side sectional view of a perforating gun section with a detonating cord.

Referring now to FIG. 3, there is shown an exemplary perforating device section 140 that includes the detonating cord 20. The section 140 may include a window 142 for accessing an inner bore 144 in which the detonating cord 20 is disposed. The section 140 has a longitudinal axis 146 to which the detonating cord 20 is parallel. In embodiments, the clip 100 may be used to attach the detonator 102 to the detonating cord 20. It should be noted that the clip 100 orients the detonating cord 20 substantially parallel with the longitudinal axis 146 and orients the detonator 102 transverse to the detonating cord 20. By "substantially," it is mean less than a forty-five degree angular offset.

Figure 4:
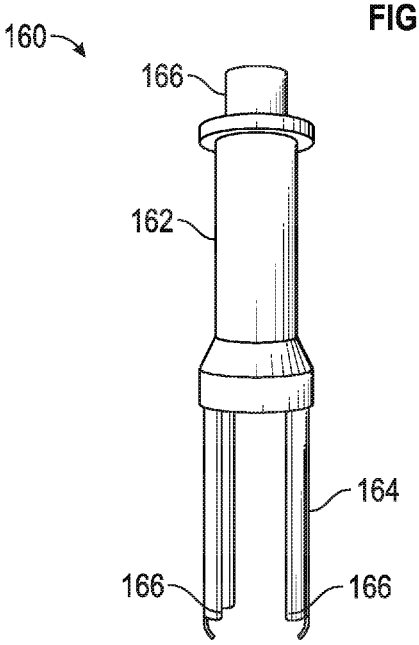
FIGS. 4 and 5 schematically illustrate an installation tool according to one embodiment of the present disclosure for installing a detonating cord and clip into the perforating gun section of FIG. 3.
Figure 5:
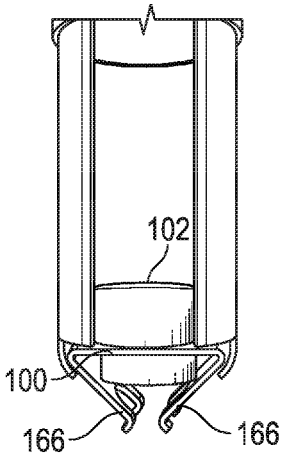

Referring now to FIG. 4, there is shown an installation tool 160 that may be used to connect the clip 100 (FIG. 1) and detonator 102 (FIG. 1) to the detonating cord 20 (FIG. 1). The installation tool 160 includes a handle 162 and pincers 164 that are biased to a closed position. A plunger assembly 166 may be used to expand the pincer ends 166 when needed. For example, the plunger assembly 166 may include a spring actuated detent that pushes the pincer ends 164 apart. Referring to FIG. 5, there is shown the clip 100 and the detonator 102 captured between the pincer ends 164. In some embodiments, the pincer ends 164 may have curvature or profile that is complementary to the clip base 104.

Referring now to FIGS. 1, 3 and 5, the clip 100 is first fixed to the detonator 102 with the fastening element 115. Next, the installation tool 160 is expanded and then allowed to close around the clip 100. Thereafter, the installation tool 160 may be used to insert the clip 100 and detonator 102 laterally through the window 142. By lateral, it is meant a direction generally orthogonal to the longitudinal axis 146. Once the clip 100 and detonator 102 is positioned next to the detonating cord 20, the clip 100 is pressed until the prong ends expand to allow passage of the detonating cord 20. The force needed to expand the prong ends 166 may be in the range of 10-20 lbs. Thereafter, the prong ends 166 snap back to the closed position and compress the detonating cord 20 against the face 108 of the detonator 102. After the detonator 102 is secured to the detonating cord 20, the plunger assembly 164 (FIG. 3) is depressed to open the pincer ends 164 to release the clip 100. Now, the installation tool 160 may be extracted from the perforating gun section 140.

Before or after the installation tool 160 is disconnected from the clip 100, the detonator 102 may be electrically connected to wiring used to activate the detonator 102. Once the internal components are assembled, a cover or lid (not shown) may be used to cover and seal the window 144. In some embodiments, the interior of the sub 140 may be fluid tight and pressurized. In embodiments, the detonator 102 is connected to only the clip 100 and the wiring (not shown) used to activate the detonator 102. That is, the detonator 102 "floats" inside the section 140, i.e., the section 140 does not have surfaces positioned to support or secure the detonator 102.

It is contemplated that suitable materials for the described embodiments include hardened spring steel and other metallic and non-metallic flexible materials. However, the present invention is not limited to any particular material. That is, any material that is sufficiently elastic and provides the spring force needed to secure the detonating cord 20 to the detonator 102 may be used.

Figure 6:
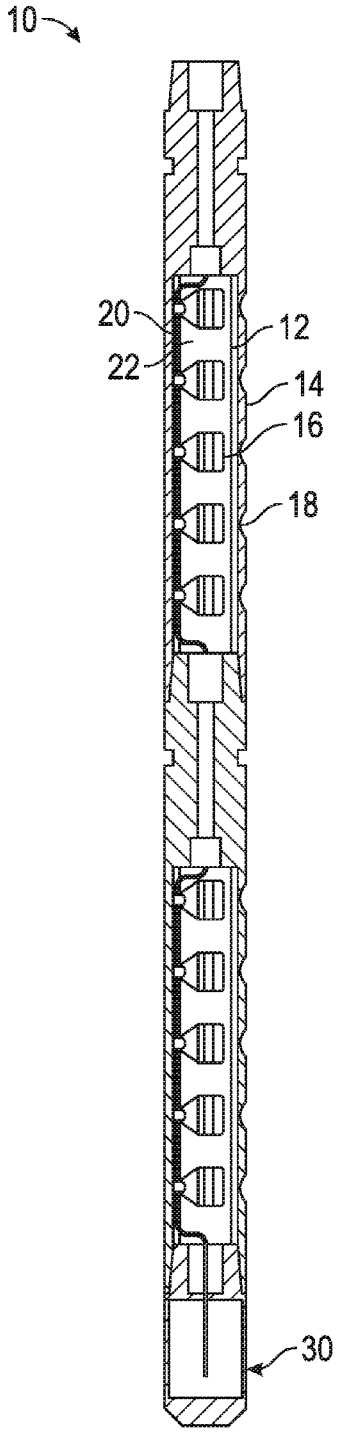
FIG. 6 illustrates a side sectional view of a perforating gun assembly that may use a clip according to the present disclosure.
Figure 7:
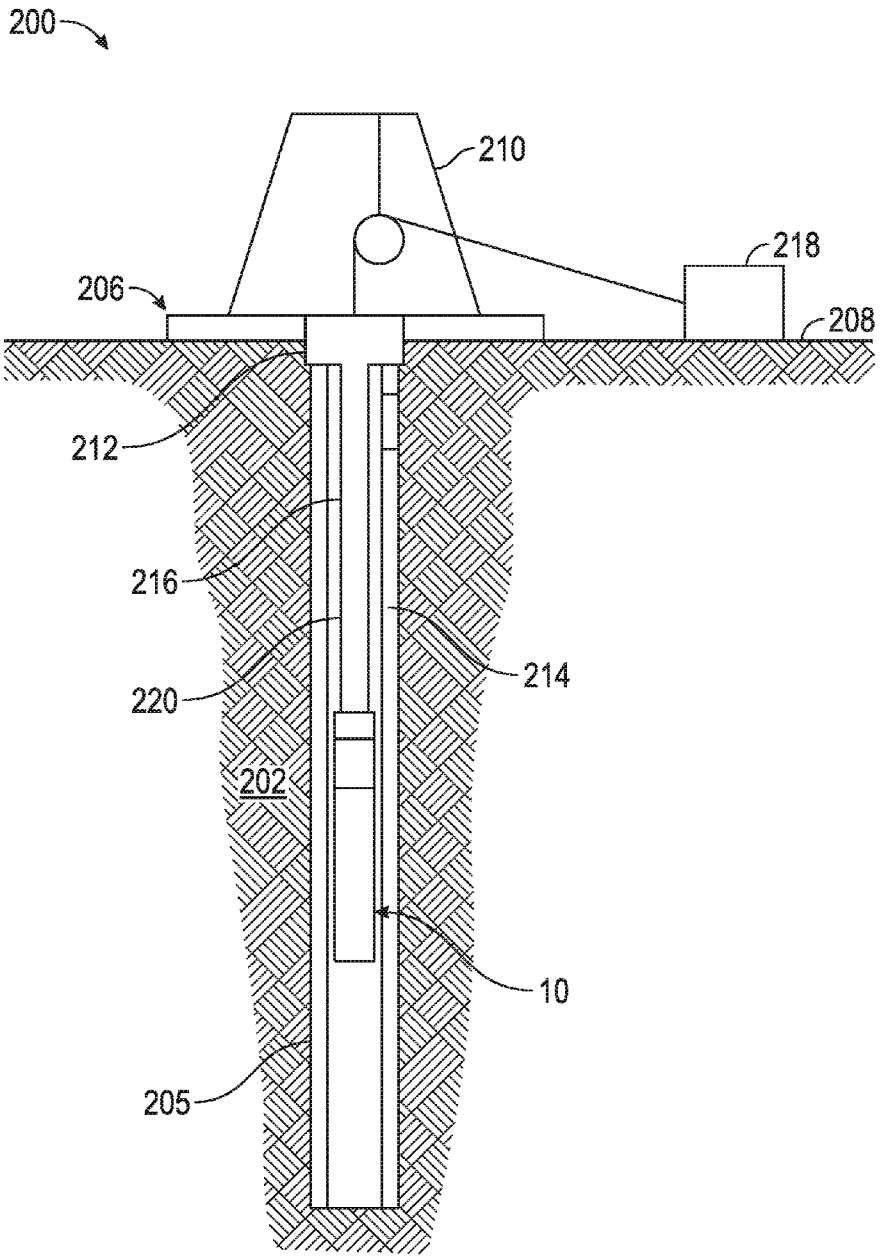
FIG. 7 schematically illustrates well in which a perforating gun assembly constructed in accordance with the present disclosure may be used.

Referring now to FIGS. 6 and 7, there is shown a perforating tool and perforating gun system, respectively, that may utilize the teachings of the present disclosure.

Referring to FIG. 6, there is shown a conventional perforating tool or gun 10. The gun 10 includes a charge strip or tube 12, concentrically positioned in a carrier tube 14. Fixed within the charge tube 12 are shaped charges 16. Typically, the charge tube 12 is oriented in the carrier tube 14 such that the shaped charges 16 on each charge strip (not shown) align with weakened portions or scallops 18 formed in the carrier tube 14. A detonating cord 20 runs through a bore 22 in the perforating gun 10. The perforating gun 100 further includes a sub 30 in which the detonator 102 (FIG. 1) is positioned and connected to the detonating cord 20 (FIG. 1) with the clip 100 (FIG. 1). Generally speaking, the carrier tube 14 and the sub 30 may be tubular or cylindrical enclosures that function as housings for various components. While shown as separate structures, the sub 30 may be integral with the carrier tube 14. The perforating gun 10 is assembled at the surface and conveyed into a wellbore via the system shown in FIG. 7.

In FIG. 7, there is shown a well construction and/or hydrocarbon production facility 200 positioned over a subterranean formation of interest 202. The facility 200 can include known equipment and structures such as a platform 206 at the earth's surface 208, a rig 210, a wellhead 212, and cased or uncased pipe/tubing 214. A work string 216 is suspended within the well bore 205 from the derrick 210. The work string 216 can include drill pipe, coiled tubing, wire line, slick line, or any other known conveyance means. The work string 216 can include telemetry lines or other signal/power transmission mediums that establish one-way or two-way telemetric communication from the surface to the downhole tool 204 connected to an end of the work string 216. In one arrangement, a telemetry system having a surface controller (e.g., a power source) 218 may be used to transmit electrical signals via a cable or signal transmission line 220 in the work string 216 to a perforating tool 10.

After the perforating gun 10 is positioned at a desired target depth in the wellbore 205, a control signal may be sent via the signal transmission line 220 to activate the detonator 102. Alternatively, the hydraulic pressure may be increased in the wellbore 205 or a percussion-type drop tool may be used to impulsively impact the detonator 102. Once activated, the detonator 102 emits a high order detonation that detonates the detonating cord 20. Thereafter, the detonating cord 20 detonates the shaped charges 16.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A method for assembling a perforating gun that has a detonator section in which a window is formed, comprising:

disposing a detonating cord in an inner bore of the perforating gun;

fixing a clip to a detonator, wherein the clip has a planar base, an opening formed in the base for receiving the detonator, and a pair of prongs extending from the base, wherein each prong of the pair of prongs extends from an edge of the base and has a gripping end;

gripping the clip with an installation tool;

inserting the clip laterally through the window of the detonator section using the installation tool; and attaching the clip to the detonator cord by pressing the clip against the detonator cord using the installation tool.

2. The method of claim 1, wherein the planar base and prongs form a triangular shape.

3. The method of claim 1, wherein the prongs are resilient and expandable to form a gap, and further comprising passing the detonating cord through the gap.

4. The method of claim 1, further comprising fixing the detonator to the detonator clip with a fastening element.

5. The method of claim 1, wherein a contact between the detonator and the detonating cord is between the base and the gripping ends.

6. The method of claim 1, wherein the clip orients the detonator cord substantially parallel to a longitudinal axis of the detonator section and orients the detonator substantially transverse to the detonating cord.

7. The method of claim 6, wherein the detonator does not enclose an end of the detonating cord and wherein the detonator only contacts an outer circumferential surface of the detonating cord.

8. The method of claim 1, wherein the installation tool has a handle and a pair of pincers extending from the handle.

9. The method of claim 1, further comprising: electrically connecting the detonator to wiring.

10. The method of claim 1, further comprising covering and sealing the window.

11. The method of claim 1, wherein the detonator floats in the detonator section.

* * * * *